US009050240B2

(12) United States Patent
Howsam

(10) Patent No.: US 9,050,240 B2
(45) Date of Patent: Jun. 9, 2015

(54) ADULT TOY WITH SELF-LUBRICATING SYSTEM

(71) Applicant: Nigel Marc Davies, Hanwell (GB)

(72) Inventor: Christopher Howsam, Devon (GB)

(73) Assignee: Nigel Marc Davies, London (GB)

( * ) Notice: Subject to any disclaimer, the term of this patent is extended or adjusted under 35 U.S.C. 154(b) by 1 day.

(21) Appl. No.: 13/896,076

(22) Filed: May 16, 2013

(65) Prior Publication Data

US 2014/0148740 A1 May 29, 2014

(30) Foreign Application Priority Data

Nov. 23, 2012 (GB) ..... 1221094.4

(51) Int. Cl.

| | |
|---|---|
| ***A61H 19/00*** | (2006.01) |
| ***A61H 23/00*** | (2006.01) |
| ***B65D 1/00*** | (2006.01) |

(52) U.S. Cl.

CPC ..... *A61H 19/44* (2013.01); *A61H 2201/105* (2013.01); *A61H 23/00* (2013.01); *B65D 1/00* (2013.01)

(58) Field of Classification Search

USPC ..... 601/46, 15, 17, 21, 67, 69, 70, DIG. 2, 601/DIG. 14, DIG. 16, 56, 57, 61, 72, 73, 601/80, 84, 87, 97, 101, 107, 109, 111; 600/38

See application file for complete search history.

(56) References Cited

U.S. PATENT DOCUMENTS

| | | | | |
|---|---|---|---|---|
| 2,448,846 | A * | 9/1948 | Trochim | 601/154 |
| 5,072,762 | A * | 12/1991 | Jimenez | 141/329 |
| 6,350,230 | B1 * | 2/2002 | Kontos | 600/38 |
| 7,322,945 | B2 * | 1/2008 | Dunmore | 601/15 |
| 2003/0120185 | A1 * | 6/2003 | Dirks et al. | 601/15 |
| 2003/0171647 | A1 | 9/2003 | Garland | |
| 2004/0034315 | A1 * | 2/2004 | Chen | 601/72 |

(Continued)

FOREIGN PATENT DOCUMENTS

| | | | |
|---|---|---|---|
| CN | 201481750 | U | 5/2010 |
| DE | 19506437 | A1 * | 8/1996 |

(Continued)

OTHER PUBLICATIONS

Foreign search report for Application No. GB1221904.4 dated Mar. 4, 2013.

(Continued)

*Primary Examiner* — Quang D Thanh

(74) *Attorney, Agent, or Firm* — Thomas | Horstemeyer, LLP

(57) ABSTRACT

An adult toy, such as a phallus-shaped vibrator, has a hollow core, a tip coupled to an end of the core and a handle containing a control interface allowing user control of the vibrator. The handle, which is coupled to the core at a distal end to the tip, houses a peristaltic pump that engages a flexible pipe network. The hollow core incorporates an access door that, when opened, allows loading of a reservoir cartridge into an internal compartment of the core. Under selective microprocessor control, the peristaltic pump spins its rotor assembly to engage and squeeze part of the pipe network. This squeezing effect encourages lubricant, liquid hormonal stimulant or other chemical solutions to exit the cartridge and controllably flow through the pipe network. With ejection of lubricant from the cartridge, the internal volume of the cartridge decreases.

12 Claims, 12 Drawing Sheets

(56) References Cited

U.S. PATENT DOCUMENTS

| | | | | |
|---|---|---|---|---|
| 2006/0015043 | A1* | 1/2006 | Hornsby et al. | 601/17 |
| 2008/0009775 | A1* | 1/2008 | Murison | 601/46 |
| 2009/0093673 | A1 | 4/2009 | Lee | |
| 2009/0275796 | A1 | 11/2009 | Gil | |
| 2013/0060081 | A1* | 3/2013 | Carter et al. | 600/38 |
| 2013/0123674 | A1* | 5/2013 | Carter et al. | 601/46 |

FOREIGN PATENT DOCUMENTS

| | | | | | |
|---|---|---|---|---|---|
| DE | 202007001331 | U1 | | 4/2007 | |
| GB | 2463854 | A | | 2/2012 | |
| GB | 2508192 | | * | 5/2014 | A61H 23/00 |
| KR | 1020050036701 | A | | 4/2005 | |
| WO | 2007041853 | A1 | | 4/2007 | |

OTHER PUBLICATIONS

Foreign search report for Application No. GB1221093.6 dated Mar. 4, 2013.

Cascade Toys "Lube Play", available from http://www.casace-tyos.com/ Accessed Jan. 3, 2013.

www.odeco.com/cnen/show.asp?nid=818; Odeco Model No. 6002GS. Accessed Online: May 20, 2013.

Ridin' Solo-Masturbation Lube-Buy Online at Ann Summers. Accessed Online: May 20, 2013.

Booty Relax-Anal Lube-Buy Online at Ann Summers. Accessed Online: May 20, 2013.

www.lelo.com/index.php?collectionName=insignia-luxe &groupName=ISLA; LELO. Accessed Online: May 20, 2013.

* cited by examiner 124a
124b 120
122

130a

130b 142
130n 172
134
148

130a
160
158

136
146
152

ADULT TOY WITH SELF-LUBRICATING SYSTEM

This application claims priority to and the benefit of United Kingdom patent application number GB 1221094.4, filed Nov. 23, 2012, which is incorporated by reference herein in its entirety.

BACKGROUND TO THE INVENTION

The present invention relates, in general, to intimate lifestyle products that provide personal massaging and, more especially, to an adult toy (often referred to as a "vibrator" or "toy") containing a self-lubricating system.

SUMMARY OF THE PRIOR ART

In terms of the form of intimate lifestyle products (interchangeably referred to herein as adult toys or "vibrators"), these frequently phallic-shaped objects are inserted into vagina or anal cavity to promote organ stimulation through localised vibration from an internal electric motor. Other designs can include a secondary flexible spur (or "rabbit") that extends angularly outwardly of the principal shaft, with the flexible spur lying (in use) outwardly of the body cavity and in general abutting engagement against other genitalia, such as the clitoris. Other shapes of vibrator are possible.

From a functional perspective, vibrators may include one or multiple motors. For example, the main phallic shaft may include a first motor whereas the spur and/or trunk of the phallic shaft may house a secondary motor to provide a sensation at each "pleasure point". The motors can be operated with numerous controllable intensities and vibration sequences, although their basic operation is either a synchronized pulse or continuous vibration. Generally, the motor is positioned at the point where maximum stimulation is desired, e.g. at a tip of the principal shaft design to target specific locations, such as the G-Spot. For example, the JIMMY-JANE FORM 6 VIBE vibrator features cordless recharging of two independent motors—one in the tip and another in the thicker part of the shaft. The ODECO OD-6002GS vibrator provides a vibrator having one-touch selection of pulse or vibration events.

From a mechanical perspective, top-end vibrators invariable make use of body-safe (e.g. FDA-approved) silicone for the outer surface of the shaft, while a light metallic-coated ABS core provides a structural framework upon which a unitary (i.e. one-piece) silicone molding can be mounted. In this fashion, vibrators are typically waterproof. LELO is a manufacturer of this form of vibrator.

Improving user experience underpins successful vibrator products, but achieving heightened experiences seldom requires brute power. Indeed, higher powered electrical motors that provide significant variations in power settings and frequency are considered as generally undesirable for three reasons: i) component cost; ii) size to the extent that motor should be generally lightweight and mountable within the vibrator's shaft or overall design; and iii) potential noise considerations, especially since the use of intimate lifestyle products may, on occasion, demand or require a degree of discretion. To date, designers have had to compromise between the need for larger and more powerful motors (to satisfy user demands for higher stimulation, when needed) and the incumbent disadvantages of increased weight, increased noise and higher battery-drain.

It is further noted that, with the use of intimate lifestyle products such as vibrators, circumstances or desire generally require the use of lubricants, such as ANN SUMMERS' "RIDIN' SOLO—MASTURBATION LUBE" lubricant and ANN SUMMERS' "BOOTY RELAX—ANAL LUBE" lubricant. These lubricants both facilitate use of the lifestyle product and/or increase stimulation or sensation. In advance of use of the vibrator, the lubricating product is applied to the surface of vibrators or directly to the erogenous zones or body part. Heightened experience is also obtained from lubrication and timely lubrication avoids potential soreness. However, current techniques for lubrication of sexual organs require manual interaction to be performed during masturbation or play (perhaps curtailing or temporarily stopping sensation and enjoyment), and a bottle or tube of clearly labelled lubricant to be carried or stored discreetly.

In the past, lubrication has been released by a crude method of shaking the vibrator to release the lubricant from an internal chamber. Reference is made to US patent applications US2003/171647 and US2004/034315A1.

An improved vibrator is therefore desired from both the perspectives of vibration control and supporting lubrication.

SUMMARY OF THE INVENTION

According to a first aspect of the present invention there is provided an adult toy containing a self-lubricating system comprising: a pipe network; an aperture formed in the adult toy, the aperture connected to the pipe network to provide an outlet therefor; and a peristaltic pump configured to engage externally against the pipe network, the peristaltic pump configured, in operation, positively to engage a section of the pipe network to urge fluid to travel through the pipe network in the direction of the outlet.

In a second aspect of the invention there is provided a vibrator system comprising: the adult toy of the first aspect and a collapsible cartridge containing a cartridge fluid including one or more of: a water-based organ lubricant, an oil-based organ lubricant, a liquid or gel chemical stimulant for stimulation of sex organs, liquid or gel de-sensitizer that reduces sex organ sensitivity, and a chemical that is spermicidal.

In a further aspect of the present invention there is provided a one-time use collapsible lubricant cartridge having a neck portion capped by a pierceable lid, the collapsible lubricant cartridge containing one or more of: a water-based organ lubricant, an oil-based organ lubricant, a liquid or gel chemical stimulant for stimulation of sex organs, a liquid or gel de-sensitizer that reduces sex organ sensitivity, and a chemical that is spermicidal; wherein the lubricant cartridge is adapted to locate internally within the core of the vibrator of the first aspect of the invention and to be positioned in the core by engagement of the neck portion.

Advantageously, the present invention provides a discreet self-lubrication mechanism in a vibrator, which self-lubrication system limits contact with lubricant (and the like) stored in a collapsible cartridge to just the connecting piping between the cartridge and an ejaculation point, i.e. an orifice in a (typically) silicone-based sheath cover. The use of a peristaltic pump provides a high degree of fluid control and, indeed, limits leakage at the cartridge and seepage from the orifice. The peristaltic pump is relatively small and quiet and can be discreetly located within a handle of a typical vibrator. Beneficially, the pump can be activated using a single button and can enter an automatic mode where accurate quantities of fluid can be delivered, according to a programmed sequence, through the piping for egress through the orifice.

In a preferred embodiment, an adult toy, such as a phallus-shaped vibrator, comprises a hollow core, a tip coupled to an end of the core and a handle containing a control interface allowing user control of the vibrator. The handle, which is coupled to the core at a distal end to the tip, houses a peristaltic pump that engages a flexible pipe network. The hollow core incorporates an access door that, when opened, allows loading of a one-use reservoir cartridge into an internal compartment of the core. The cartridge contains lubricant, liquid hormonal stimulant or other chemical solution for use with the vibrator. With closing of the access door, the cartridge is aligned with a tubular piercing member that pierces the cartridge and provides a fluid conduit into the flexible pipe network. Under selective microprocessor control, the peristaltic pump spins its rotor assembly to engage and squeeze part of the pipe network, with this squeezing effect encouraging lubricant, liquid hormonal stimulant or other chemical solution to exit the cartridge and controllable flow through the pipe network for eventual and generally rapid egress from a nozzle. The nozzle is formed in the tip and aligned with an orifice in a sheath cover that, in use, abuts against the handle and covers the tip and the access door.

BRIEF DESCRIPTION OF THE DRAWINGS

Exemplary embodiments of the present invention will now be described with reference to the accompanying drawings, in which.

DETAILED DESCRIPTION OF A PREFERRED EMBODIMENT

The inventor has identified that existing vibrators are actually fairly inefficient and wasteful of energy. The various embodiments of the present invention therefore produce a targeted vibration that is localised to a structural feature of the vibrator design, for example, to engage the G-Spot and/or prostrate gland.

Figures 1, 1A, 1B:
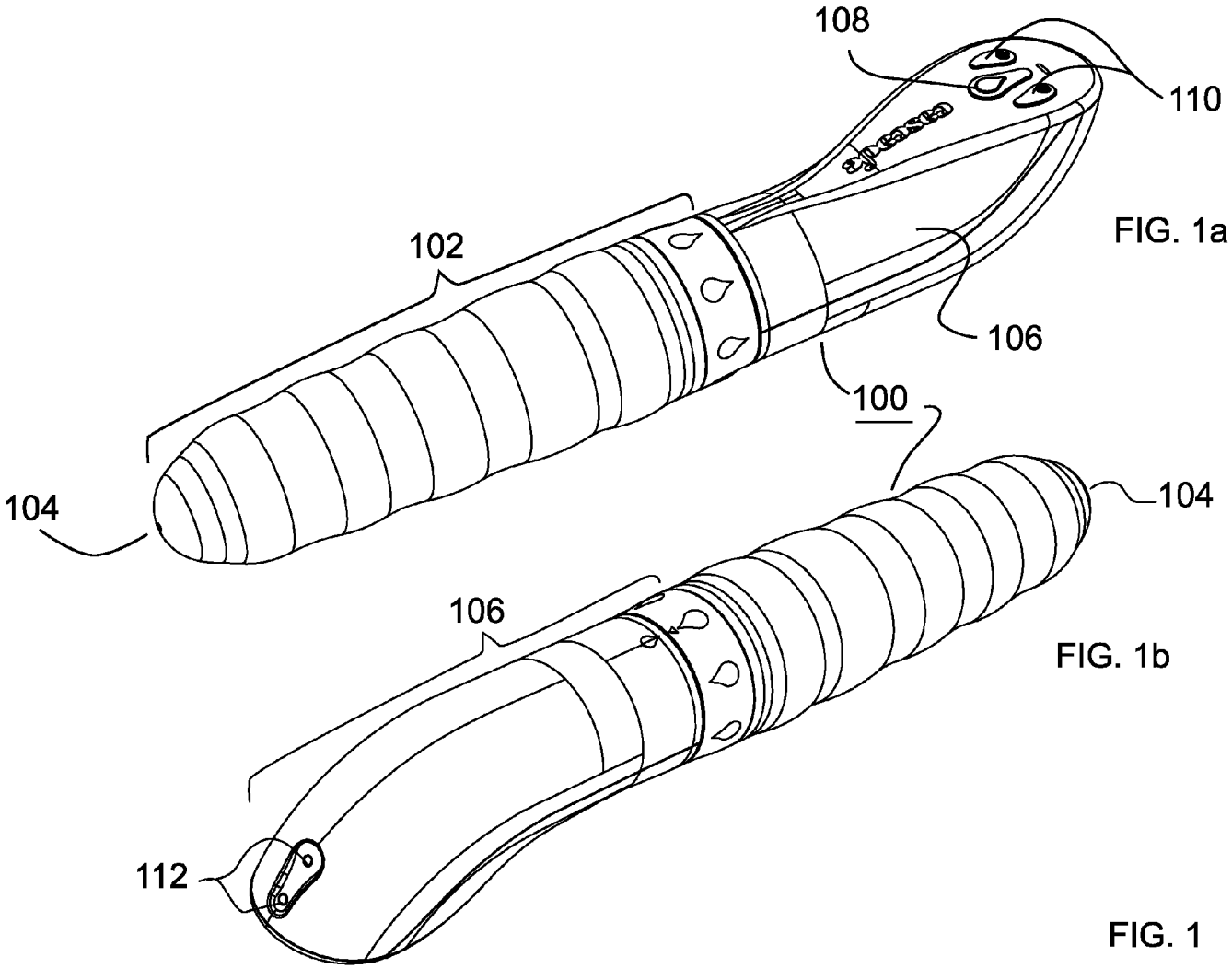
FIGS. 1A-1B show perspective views of a vibrator according to a preferred embodiment of the present invention.

Turning to FIG. 1 there are shown front and rear perspective views of a vibrator 100 according to a preferred embodiment of the present invention. The vibrator essentially comprises two portions, namely: i) a sheath region 102 that houses a motor to cause vibration at a particular point, such as at a tip 104, of the sheath region 102; and ii) a handle 106 ergonomically designed to be clasped in the hand. The handle usually incorporates a control interface 108, such as buttons 110, for selecting and controlling operating programs/parameters of the vibrator 100. Optionally, the handle may also include limited illumination capabilities provided by backlighting and an LED source. Typically, the handle will be made from a suitably smooth plastics material. The handle 106 typically houses control electronics and some form of power supply, such as an internal rechargeable battery (not shown) of appropriate voltage.

Figures 2, 2A, 2B, 2C:
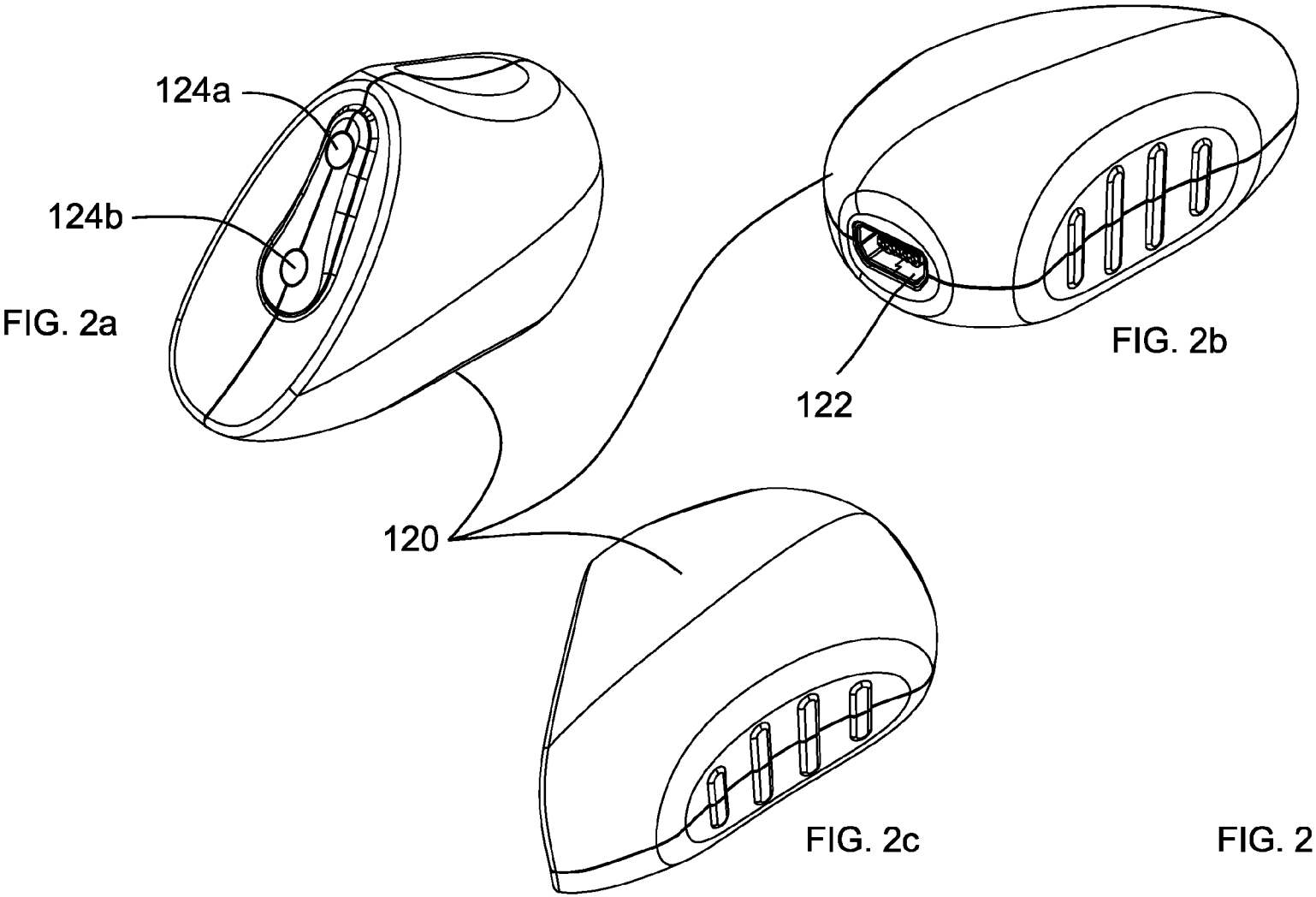
FIGS. 2A-2C show perspective views of a preferred charging unit for the vibrator of FIG. 1.

Brief reference is made to FIG. 2 which shows a low-voltage, fast charge battery charging unit 120 for the vibrator of FIG. 1. The battery charging unit 120 incorporates an adaptor, such as a USB port or the like 122, that allows a wired connection to be established to a suitable power supply. To maintain an effective electrical connection between a mating pair 124*a*, 124*b* of charging contacts on the battery charging unit 120 and corresponding battery contact pads 112 located on the handle (that provide electrical communication to the internal battery), the charging contacts may be mounted within or make use of a magnetic connection that, for example, exploits the strong and permanent magnetic properties of neodymium magnets. In the same way that the overall shape and size of the vibrator 100 is open to aesthetic and some ergonomic design considerations, the shape of the battery charging unit 120 is similarly free although generally small. The charger's circuitry is well known.

Figures 3, 3A, 3B, 3C, 3D, 3E:
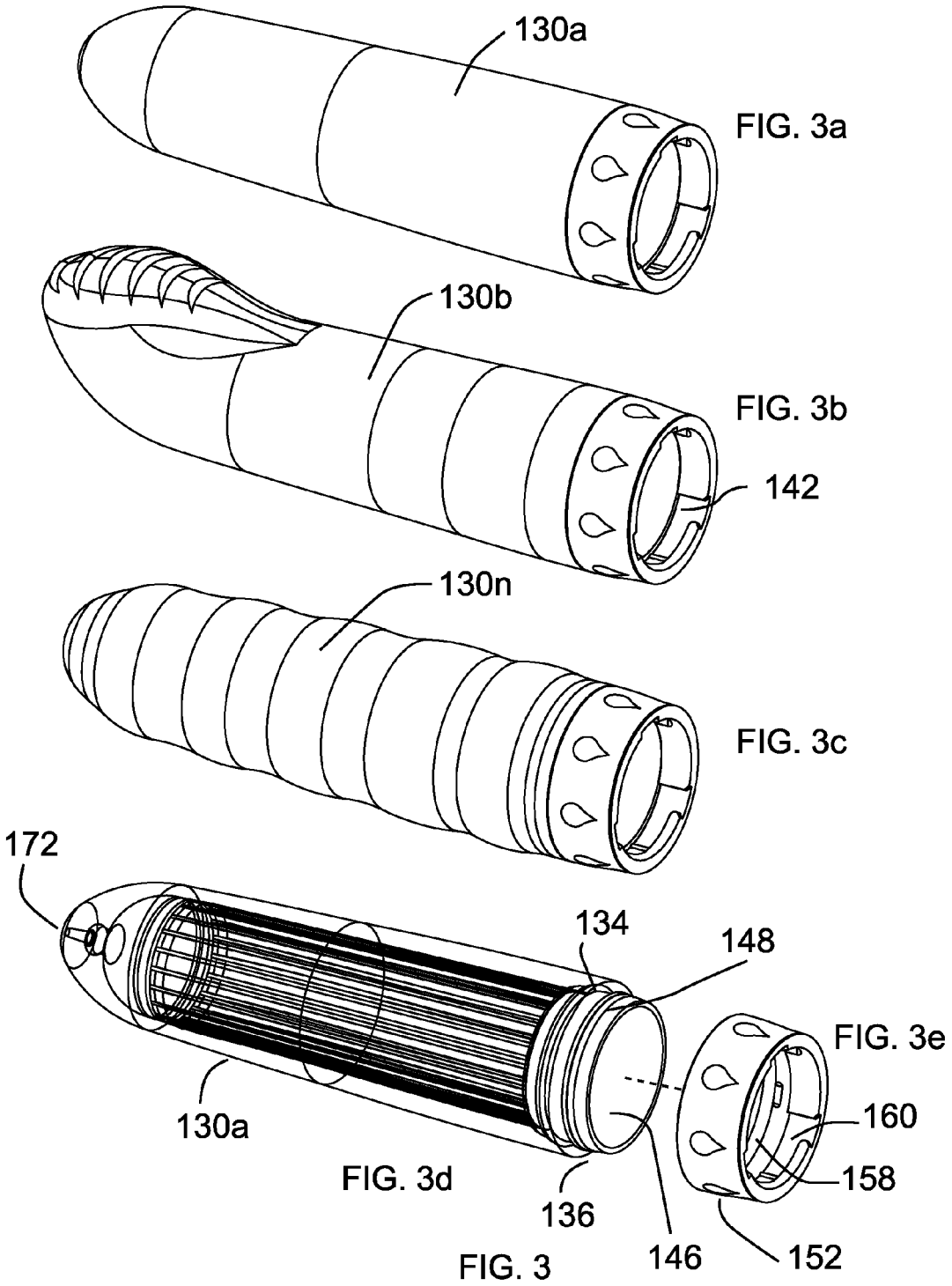
FIGS. 3A-3E show alternative embodiments of removable silicone sheath covers for the vibrator of FIG. 1.

With brief reference to FIG. 3, the shape of the sheath region 102 can take any number of forms and may include, but are not be limited to, ribbed, flat and/or bulbous features (as will be understood). Bulbous features are generally formed using additional material. Some flexibility in the features may be desirable. The sheath region 102 is usually anatomically shaped and sized to generally resemble a phallus. The sheath region 102 is frequently made from a detachable molded sheath cover 130—design variants in the drawing figure attract suffices "a", "b" and "n"—supported on an underlying and generally cylindrically-shaped, hollow core 132. [The hollow nature and specific configuration of the core will be described subsequently]. The sheath cover 130 can therefore be peeled off/slid over the core 132 to allow for maintenance, replacement and/or customization.

The sheath cover 130 is typically made from a FDA-approved silicone rubber or similar bodily inert, semi-flexible material.

The lower illustration in FIG. 3 shows a see-through view of the sheath region and particularly shows how the sheath cover 130 is arranged to be in fitting engagement with the core 132, with the fit being relatively tight but at least secure to ensure that, respectively, (i) internally generated vibrations are passed by mechanical contact between the core 132 and the sheath cover 130 and (ii) the sheath cover 130 does not inadvertently detach from the core. In more detail, the core 132 is generally domed shaped at its tip with an open neck 134 at its base. The sheath cover 130 is corresponding shaped and fits over the core 132. The sheath cover 130 and core 132 are mechanically coupled to an interface ring 136 located at the base of the sheath cover 130 and the core. The interface ring 136 positively engages into the handle 106 such as though a bayonet mount arrangement that, upon rotation of the interface ring 138, either engages or disengages, typically, a plurality of upstanding dogs on an external surface of the handle 106 to lock the entire sheath cover 130, core 132 and interface ring 136 to the handle 106. Other sealing and attachment mechanisms, such as a screw thread or interference push-fit, will be appreciated by the skilled addressee.

Figures 4, 4A, 4B:
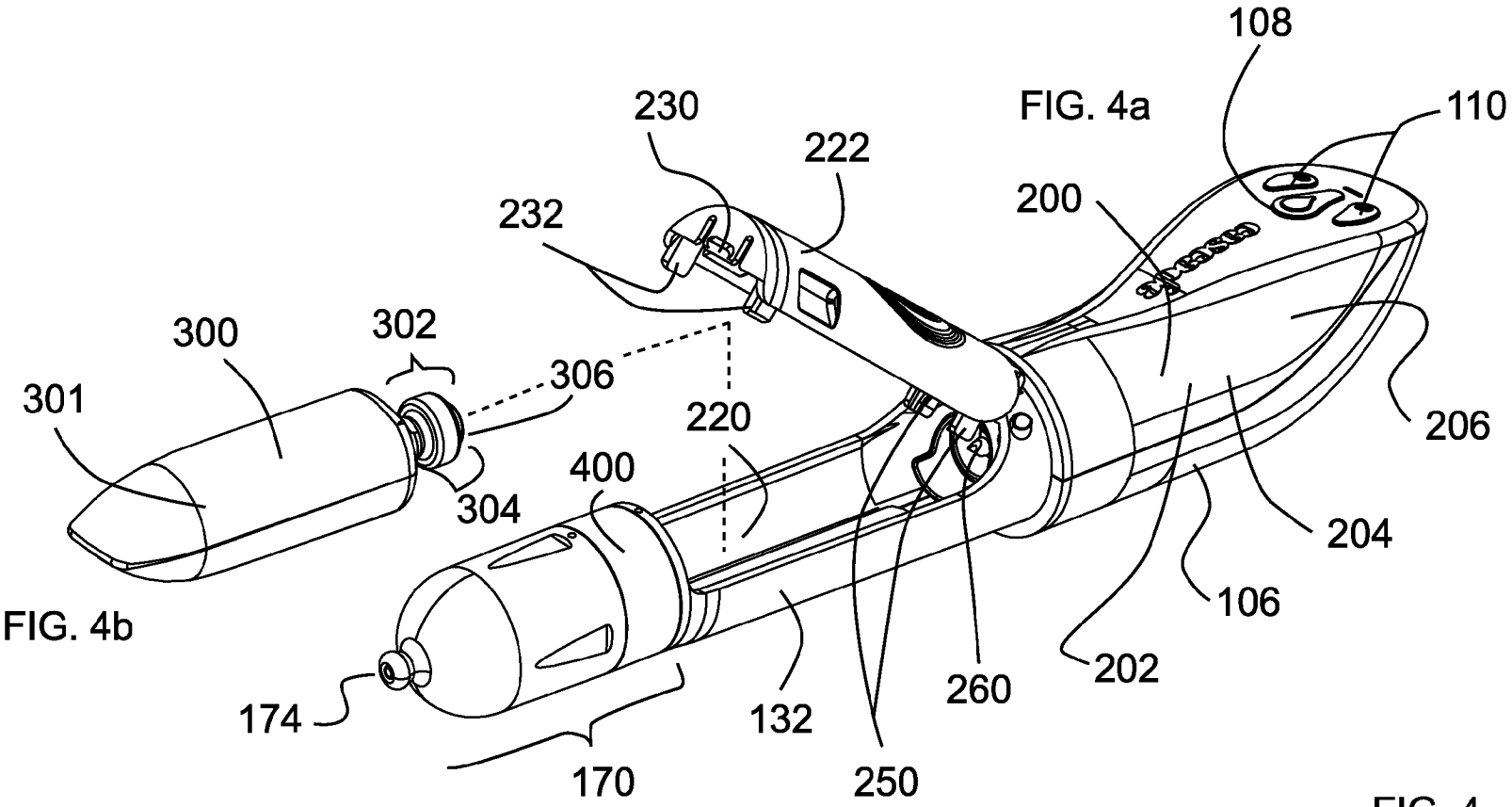
FIG. 4 shows the vibrator of FIG. 1 in which the silicone sheath cover of FIG. 3 has been removed and the vibrator's preferred configuration of a self-lubricating compartment shown open and accessible for servicing.
Figure 5:
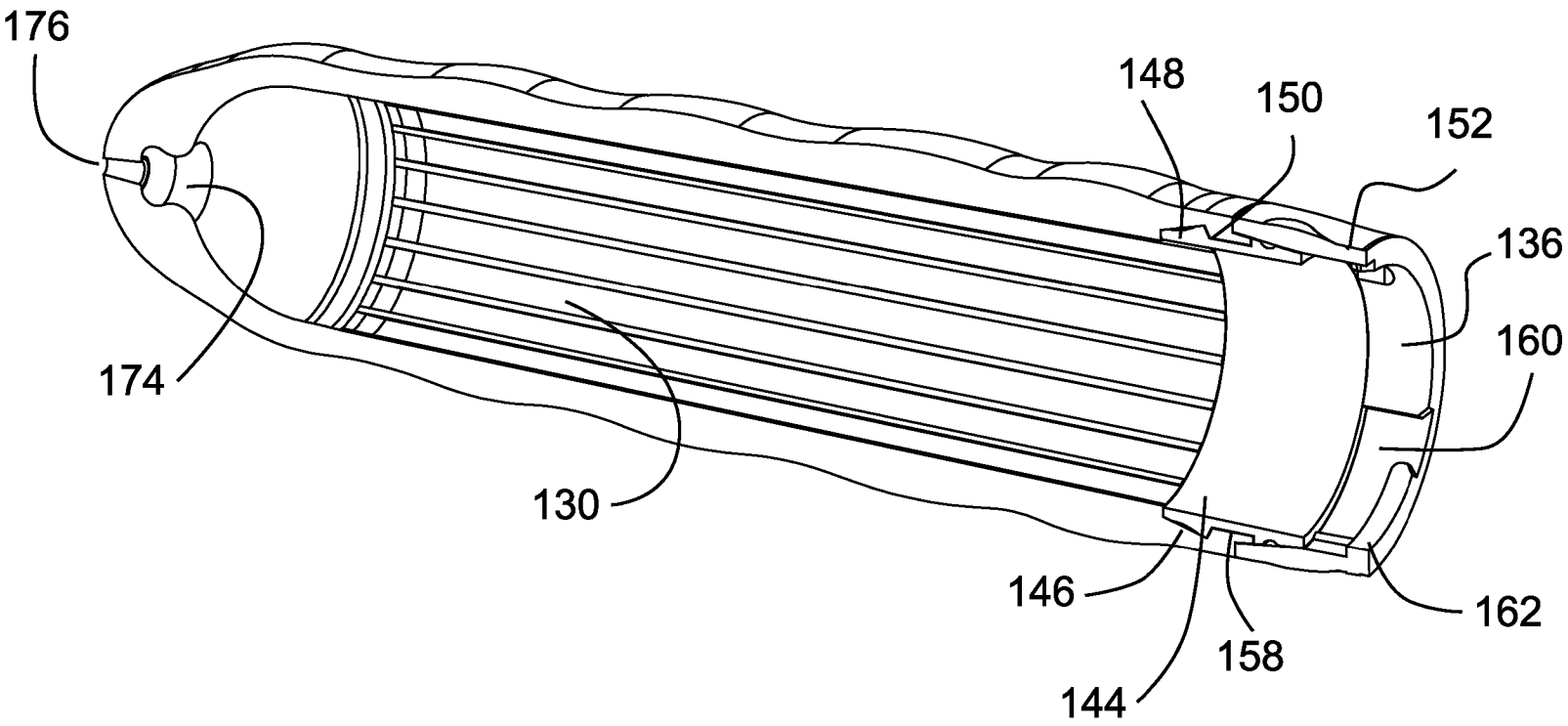
FIG. 5 is a section view through a typical removable silicone sheath cover shown in FIG. 4.

Referring briefly to FIG. 5, there is shown is a section view through a typical removable silicone sheath cover of FIG. 4. FIG. 5 reflects the preferred arrangement where the sheath cover 130 and interface ring 136 are supplied as a unitary unit. An internal collar 144 of the interface ring mechanically engages (at or near the base of the sheath cover) an inner surface 146 of the sheath cover 130. For example, the mechanical engagement may be brought about by an outwardly projecting lip 148 that produces a locking undercut region 150 into which the inner surface of 146 of the sheath cover 130 can bite. Additionally, it is preferred to glue or otherwise affix the sheath to the internal collar 146 at a sealing surface 158. The interface ring 136 includes a lower engagement section 152 that, typically, pushes over an outer edge of the internal collar 144 to produce a snap-lock fixing. The lower engagement section 152 therefore also abuts against the lower surface of the sheath cover 130, and provides a finishing surface for the base of the sheath cover and also a curtain that hides the sealing surface 158. The resulting overlap means that any excess glue is not visible. From the perspective of the preferred bayonet mount, at least one channel 160 is formed in an inner surface 162 of the lower engagement section 152.

Figure 7:
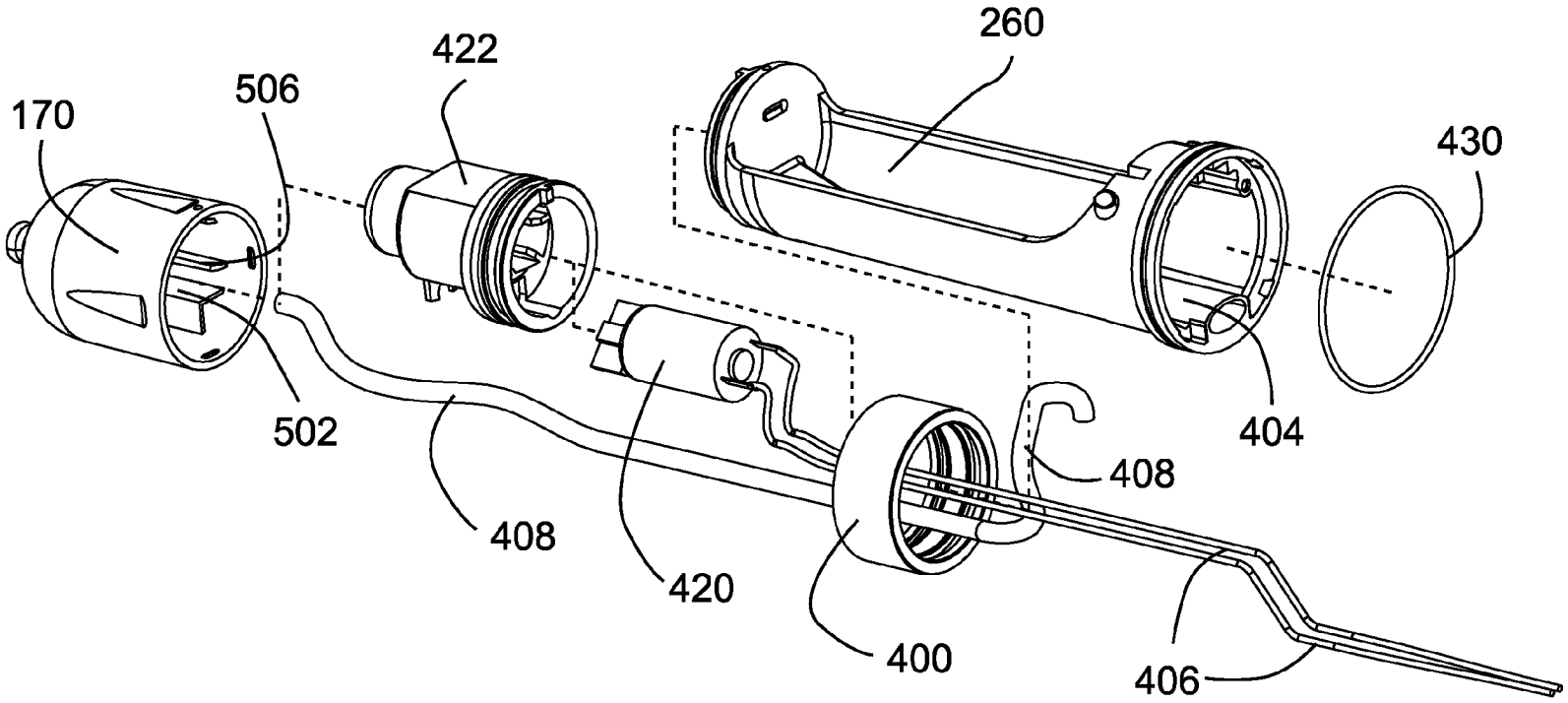
FIG. 7 is an exploded view of the typical components of the core and tip assembly of FIG. 6.
Figure 8:
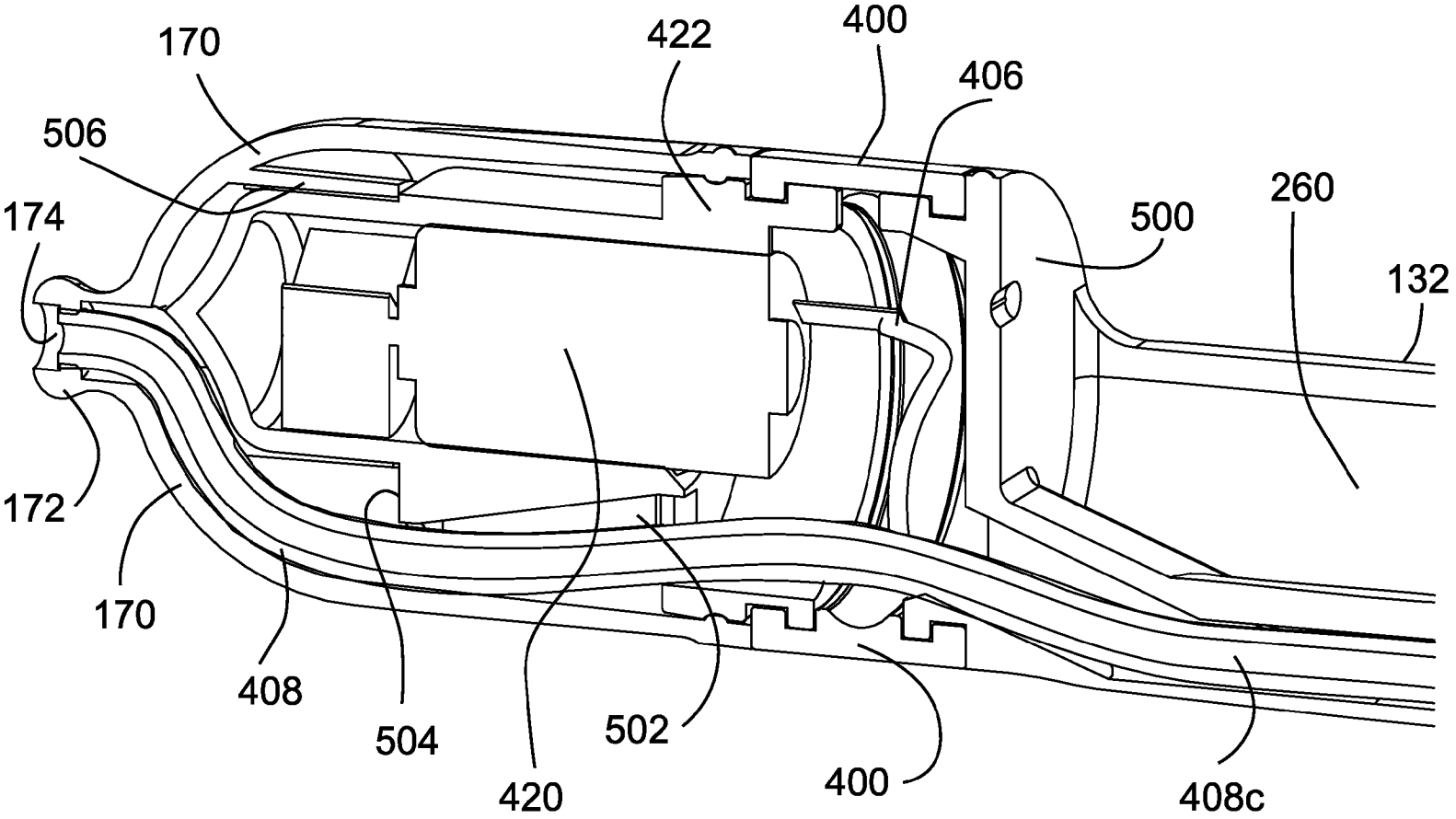
FIG. 8 is a sectional view through the tip of the core of FIG. 5.

As seen especially well in the section view of FIG. 8, a typically (and preferably) domed-shaped molding forms a tip region 170 that includes a nipple 172 defining a passageway 174 in which an end of a lubricant delivery pipe 408 (see FIG. 7, discussed below) is generally held in place. The use of a "nipple" is preferred since it provides a degree of security and protection for the terminating point of the pipe network, but any appropriately dimensioned aperture should be considered as a functional equivalent. The pipe is typically constructed from multiple pieces of pipe that form a pipe network; the various parts are referenced generally as 408 with letter suffixes, "408*a*", "408*b*", etc.

The sheath cover 130 has an orifice 176 that aligns with and over the nipple 172 to support fluid communication from (in effect) the interior of the core through to an outside environment. The orifice 176 is typically reinforced with a molded annulus that limits the chance of the diameter of the annulus from splitting open beyond a nominal diameter sufficient to allow seepage of small quantities of a lubricant, such as water-based or oil-based stimulant or sex lubricant.

Moving on to FIG. 4, the vibrator 100 of FIG. 1 has been partially deconstructed through the removal of the sheath cover 130 to reveal the generally cylindrically-shaped, hollow core 132 coupled to the handle 106. The handle, as discussed before, includes the control electronics 200 responsive to a microprocessor or microcontroller 202 (or the like) that executes program instructions (stored in memory 204) that exercise control over one or more motors and/or pumps. A power source in the form of a rechargeable battery 206 provides power to the various electrical components distributed through the vibrator.

From the perspective of the core 132, there are two regions of particular note:

1. a lubricant reservoir compartment 220 located between the tip 170 and the handle 106, which compartment 220 (defined within a body section of the core) is accessible through a door 222; and
2. a multi-element tip 170 remote from the handle 106 and attached to the body section.

Turning to the lubricant reservoir compartment 220 (formed within a main body of the core), this is dimensioned to receive a replaceable one-time use lubricant cartridge 300 containing a water- or oil-based lubricant and/or liquid or gel chemical stimulant for stimulation or de-sensitizer of sex organs or a chemical that is spermicidal in nature. Unless the context requires a specific use of a term, the gel or liquid content in the lubricant cartridge will be referred to as "cartridge fluid" or the like). The nature of the lubricant and/or stimulant is well known to the skilled addressee. The lubricant cartridge 300 may be made from any generally impermeable material, including thin polypropylene or a foil that is extruded or otherwise formed into a toothpaste-shaped tube or other typically cylindrical shape that fits within the reservoir compartment. Typically, the volume of the lubricant cartridge 300 is in the region of about ten to about thirty cubic centimeters (1 cc=1 milliliter), with the overall size and dimensions determined by the girth of the core and available cavity space given the phallus-like size of the vibrator 100. The lubricant cartridge 300 includes a neck 302 that preferably includes at least one (and preferably two) annular collars 304 and a sealable opening 306. The opening is sealed with a pierceable top or lid to retain the lubricant. Any suitable sealing top can be employed, such as an adhesive metal foil or the like.

The door 222 to access the compartment may be hinged to the core 132. However, the door may also be separable and operable as a push-fit to engage around the edge of the opening by using spring clips 230, 232 or a twist lock mechanism. The nature of fixing mechanism is readily understood by the skilled person. The nature of the plastics material for the door and/or core may be designed to allow for some movement to facilitate release of the spring clips 230.

The door 22 also includes at least one retainer clasp 250 designed to engage positively and hold the neck 302. For example, in a preferred embodiment, the retainer clasp 250 is located such that, when the door is closes, the retainer clasp is near an end of the compartment that is closest to the handle 106 and, in use, securely grips the lubricant cartridge around its collar 304. Moreover, the retainer clasp serves another purpose, namely to ensure good alignment of the pierceable top or lid of the lubricant cartridge with a tubular piercing member 260 (shown in more detail in FIG. 12) that includes a channel that connects the interior of the lubricant cartridge to a lubricant delivery pipe (described and shown especially in FIGS. 7, 8 and 12). Indeed, as the door is closed, the lid of the lubricant cartridge is guided into piercing engagement with the tubular piercing member 260. One pierced, the lid of the reservoir preferably seals around the tubular piercing member 260, with cartridge fluid therefore able to flow (or be encouraged to seep or otherwise exit) from the lubricant cartridge into the lubricant delivery pipe 408. The lubricant delivery pipe is made from a plastic material (or the like) that generally provides a degree of flexibility and which, preferable, is coated with an anti-bacterial agent but at least a surface that facilitates cleaning. Controlled release of the cartridge fluid will be described below.

The lubricant cartridge is preferably provided as a one-use unit that is replaced when drained. Given that the cartridge fluid is delivered, ultimately, into a body cavity it will be understood that a re-usable lubricant cartridges (while possible) is undesirable and presents a potential health risk arising from contamination or non-sterile replenishment of the cartridge fluid. The lubricant cartridge is therefore a merchandisable item in its own right and may be sold individually or as a pack. Indeed, the pack may include a variety of differing compositions for the cartridge fluid and a chart setting out a schedule of use.

Figure 6:
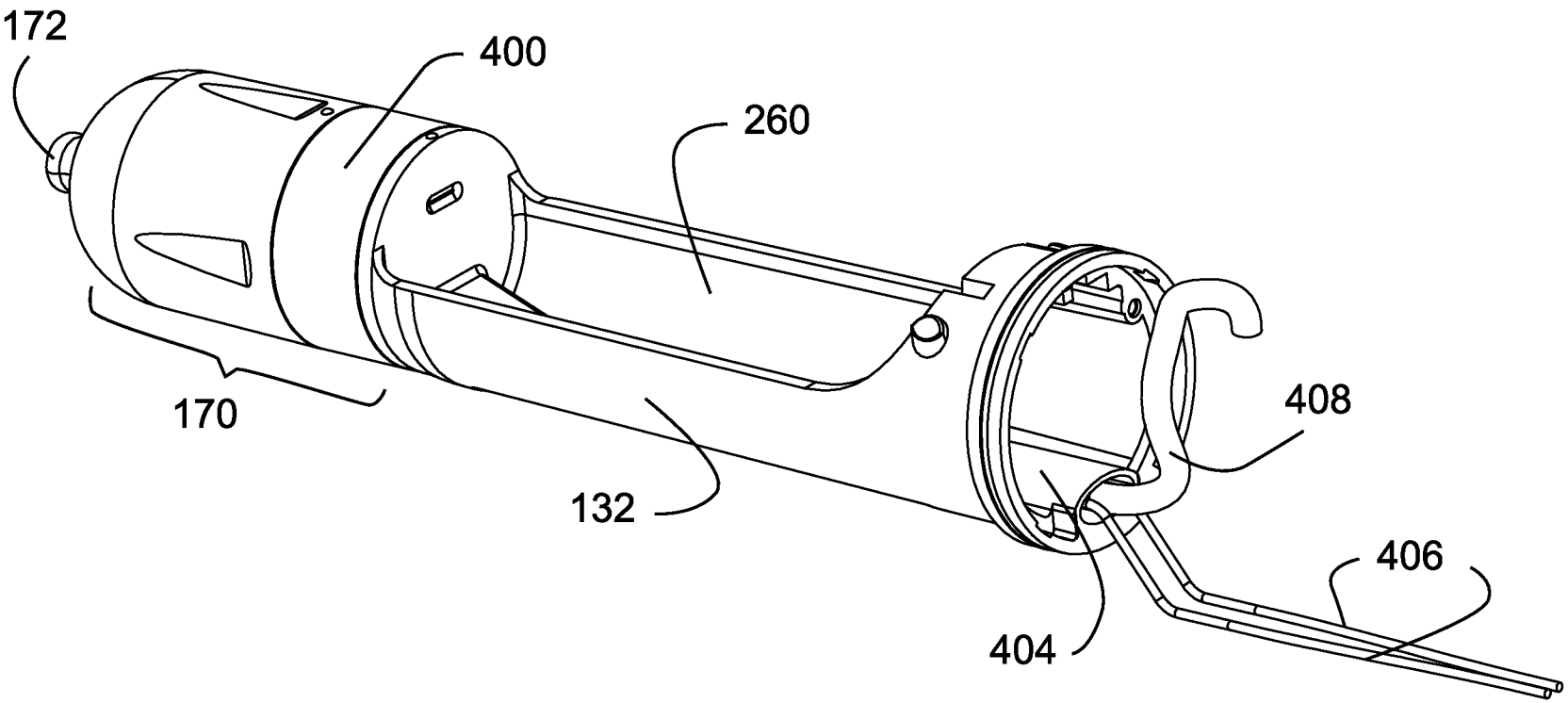
FIG. 6 is a perspective view of a preferred embodiment of a core and tip assembly of the vibrator of FIG. 1.
Figure 9:
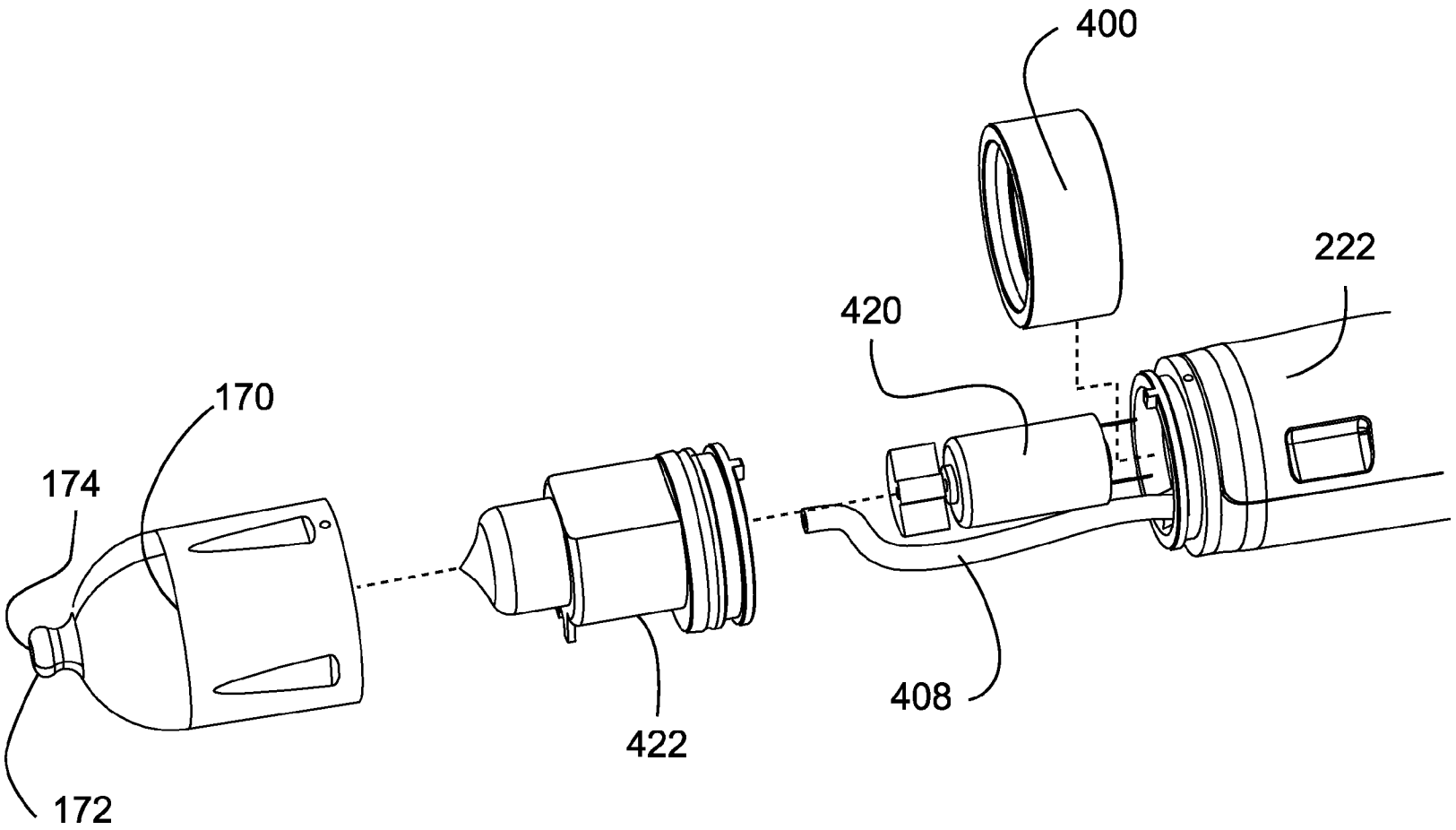
FIG. 9 is an exploded view of a preferred motor assembly within the tip of the vibrator or FIG. 1.

Turing to the tip 170 of the core 132 and with additional reference to FIGS. 6 to 9, this is a multi-piece assembly in accordance with a preferred embodiment of the present invention. FIG. 6 is a perspective view of a preferred embodiment of a core and tip assembly of the vibrator of FIG. 1. FIG. 7 is an exploded view of the typical components of the core and tip assembly of FIG. 6. FIG. 8 is a sectional view through the tip of the core of FIG. 6 and FIG. 9 is an exploded view of a preferred motor assembly within the tip of the vibrator of FIG. 1.

Following detailed analysis, the inventors have now appreciated that, with respect to vibrations in a vibrator, conventional position and construction of the vibrator relies on a brute force effect given that when the motor is fixed to the body of the vibrator there are a number of inefficiencies and problems. Particularly, with current fixed design, the overall mass of the vibrator acts to dampen the vibration effect given that the vibration is actually communicated, via the motor's mount, through the entire mass of the vibrator. Putting this differently, the finite energy in the vibrations is distributed through the entire device. Vibration is therefore not localised, with this meaning that there is less control of organ stimulation or sensation and an impaired localized effect that has no distinct boundary event. Moreover, unwanted vibration into the handle can cause discomfort and repetitive strain, with the amount of vibration in conventional toys increasing as a function of power and/or angular velocity of the eccentric weight.

FIG. 6 shows the intermediate position of a dampening ring 400 between the molded domed-shaped tip 170 and the main body of the core. The dampening ring 400 is made from rubber or other compressibly resistive material. FIG. 6 also shows a conduit 404 running through the lubricant reservoir compartment 220, which conduit 404 protects electrical wiring 406 and lubricant delivery pipe 408 (that forms part of the lubricant delivery system). FIG. 7 shows an exploded component view of FIG. 6 and how, particularly, an eccentrically weighted electric motor 420 (for producing vibration) fits relatively snugly within a motor chassis 422 that in turn is seated and held within the dome-shaped tip 170. The diameter of the dampening ring 400 is therefore generally commensurate with both that of the tip 170 and the core 132 to provide a smooth surface transition, with these components fixed together, e.g. by adhesive or the like. EMF for the motor (from the battery of FIG. 4) is routed via the electrical wiring 406. The pipe 408 of the lubricant delivery system terminates in the passageway 174 of the nipple 172 so that, in use, fluid flowing through the lubricant delivery system would controllable ooze or flow from the nipple aligned orifice 176 (of FIG. 5).

One or more 0-ring seals 430 may be provided within the core 132. For example, coupling of the body of the core (at a distal end from the tip) to, in effect, an end of the handle may require use of a specific seal to provide for waterproofing.

In use, operation of the motor therefore transmits vibration into the tip 170, while the dampening ring 400 absorbs vibrations that would otherwise propagate backwards towards the handle 106 and concentrates the available energy into a selected region, i.e. the tip and therefore the more limited mass of the tip (rather than the total mass of the vibrator).

FIG. 8 shows the assembled configuration of the tip from a section perspective. In this drawings, it is noted that the dampening ring 400 provides a coupling between the molded tip 170 and an end wall 500 in the body of the core 132. The dampening ring 400 furthermore engages the motor chassis 422 thereby separating and isolating the tip 170 from the body of the core 132. It is further noted that the motor chassis 422 is held firmly internally within the tip 170, with integral internal features 502-506 (such as inclined guiding surfaces and bracing) engaging against corresponding abutting surfaces of the motor chassis 422.

The principal of using an in-line dampening ring 400 applied at one point along the length of the core to facilitate localised vibration and inhibit (but at least reduce) vibration in the handle can be extended to multiple independently-controllable motors positioned in individual motor chassis along the core 132. Each region served by a dedicated motor is therefore substantially vibrationally isolated from another adjacent region by one or more intermediately positioned dampening rings.

Control of the motor is managed by the microprocessor (of FIG. 4) in response to user instructions (e.g. "fast", "slow", "hard", "soft", "tip", "core", combinations of those parameters or a pre-programmed or cyclic mode of operation) acquired though the control interface 108, 110. Motor control can be achieved by simply ensuring that an appropriate voltage (such as realised by an applied pulse width modulation scheme or the like that controls power/intensity and frequency of vibration) is supplied to an addressed motor through dedicated electrical wiring. Indeed, in one embodiment, motor control to multiple motors may be phased to produce a wave-like effect (or other patterned energization effect) by controlled vibration of each motor relative to any other motor(s). Of course, multiple motors could be simultaneously activated. The dampening ring 400 therefore means that particular regions of the vibrator 100 can be sensually discernible in time.

In a second complementary or independent aspect for a new vibrator, an automated lubrication delivery system 600 makes use of an internally-located peristaltic pump to delivery lubricant on a controlled basis to exude from the nipple 172 (of FIG. 4) and the orifice 176 in the sheath cover. Advantageously, the use of a peristaltic pump to control release of cartridge fluid 301 from the one-use lubricant cartridge 300 means that the lubricant delivery system does not ooze fluid in an uncontrollable fashion and, importantly, that the cartridge fluid is only exposed to the lubricant delivery pipe 408; this limits the chance of contamination of the cartridge fluid (reference numeral 301 in FIG. 4). Typically, the automated delivery system 600 is located in the handle 106 of the vibrator 100 of FIG. 4 and therefore rearward of the body of the core.

Figure 10:
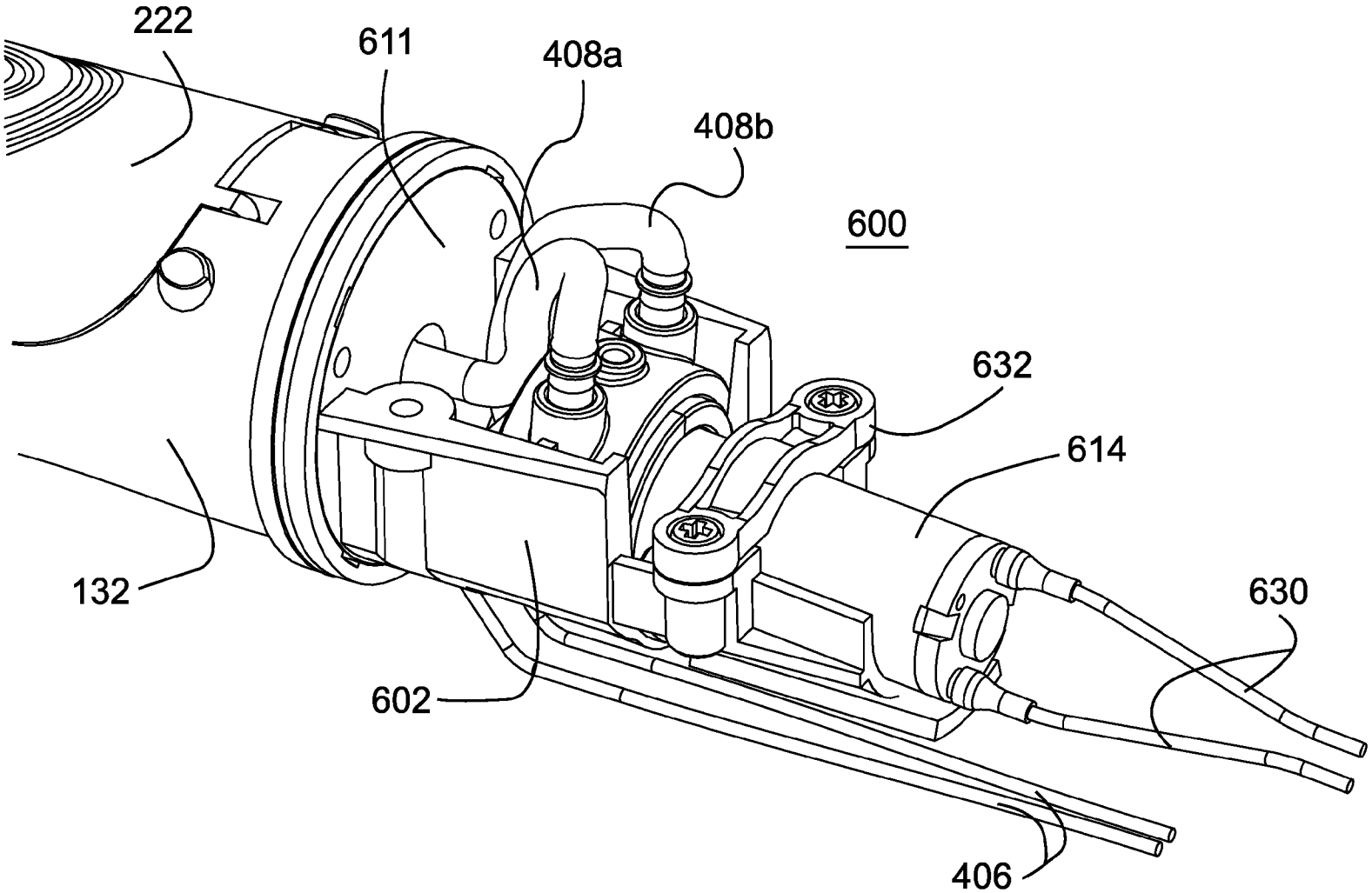
FIG. 10 shows an optional automatic lubricant delivery system according to a particular embodiment, the automatic lubricant delivery system illustrated in situ within a pump chassis of the vibrator of FIG. 1 or FIG. 8.
Figure 11:
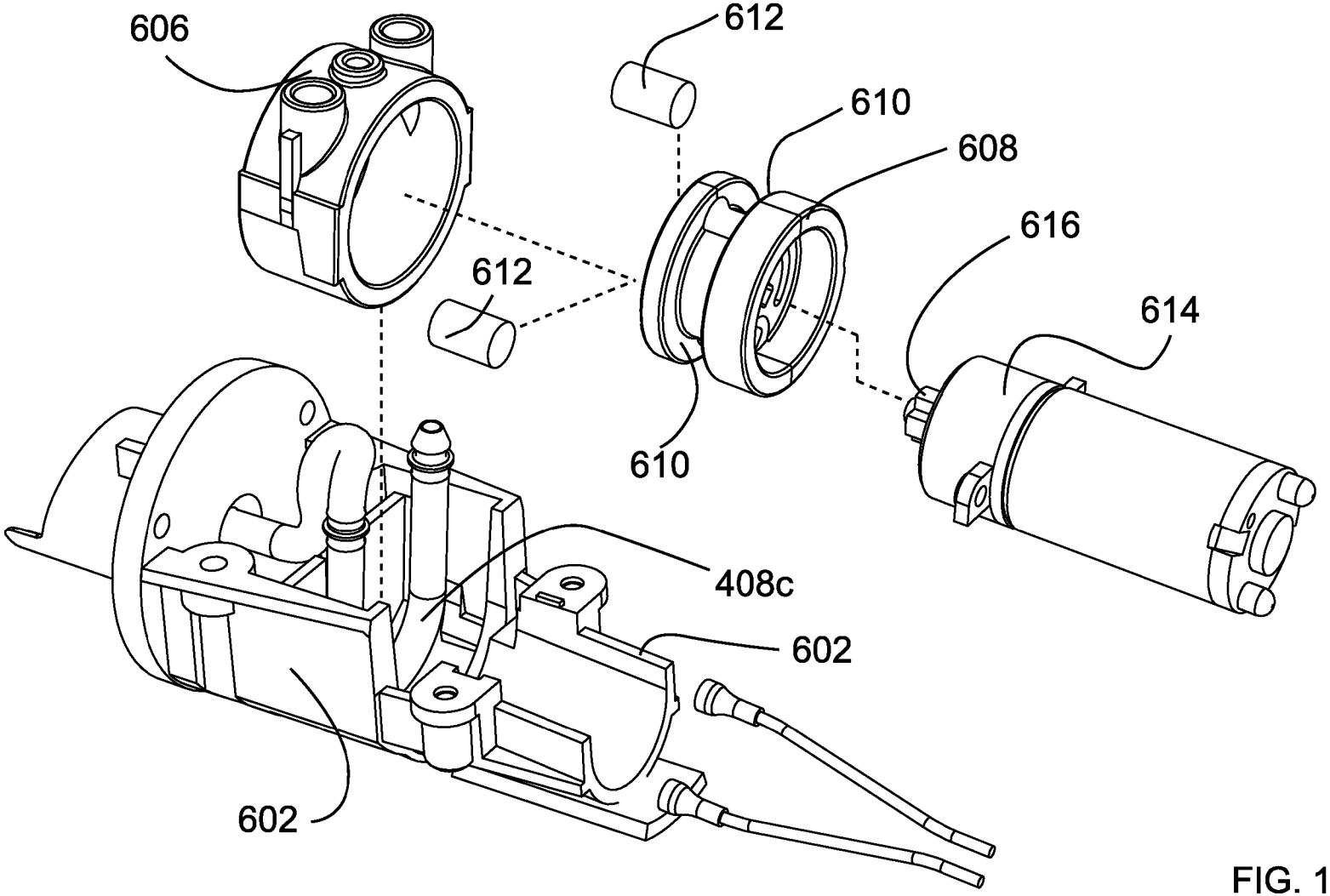
FIG. 11 is an exploded view of typical components within the automatic lubricant delivery system of FIG. 10.
Figure 12:
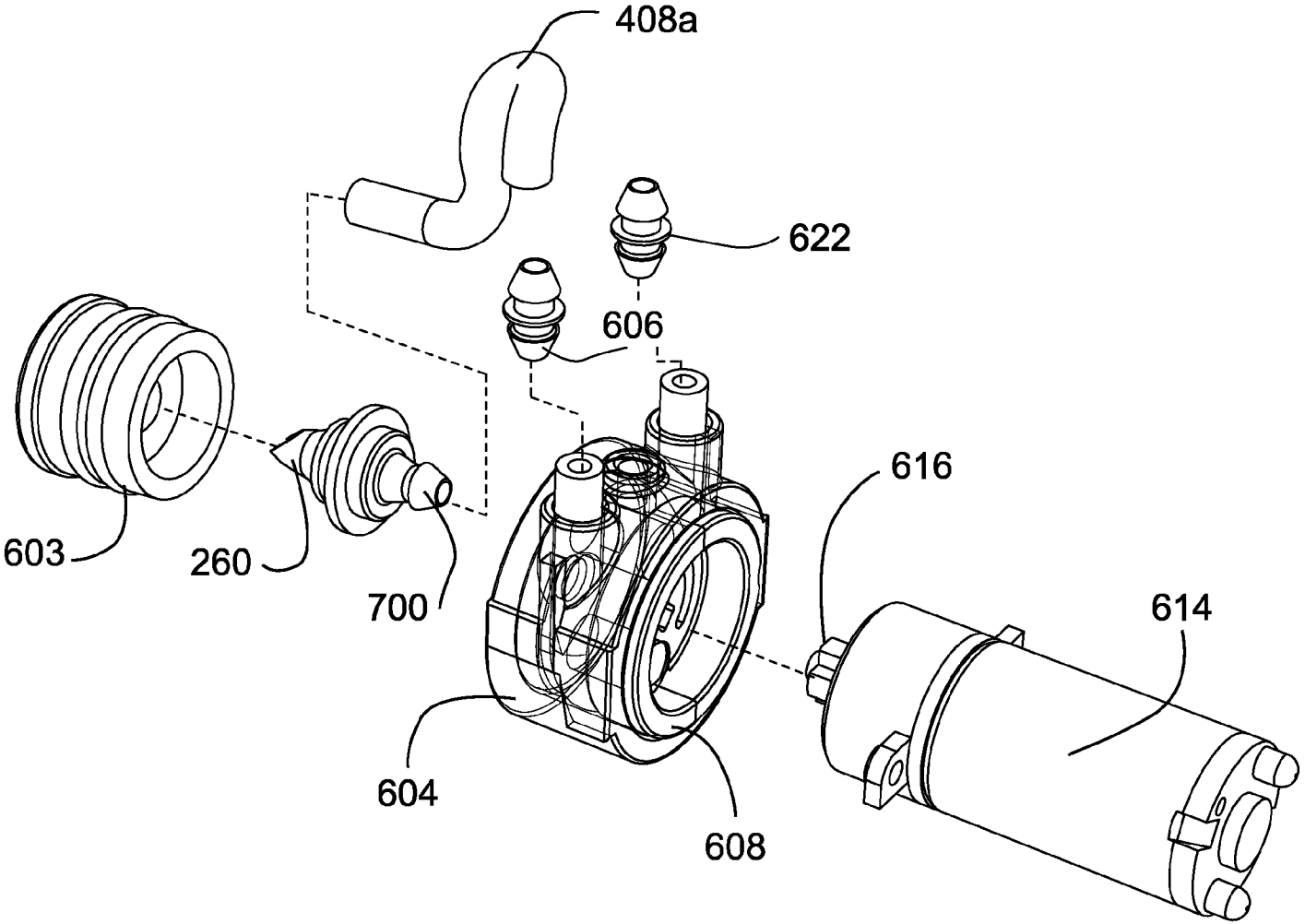
FIG. 12 is an exploded view of a peristaltic pump preferably employed within the automatic lubricant delivery system FIG. 10.

FIGS. 10 to 12 show the automatic lubricant delivery system 600 according to a particular embodiment, the automatic lubricant delivery system 600 illustrated in situ within a pump assembly carriage 602 of (for example) the vibrator 100 of FIG. 4. The assembly carriage can be integrally formed in plastic and molded as a part in the handle 106; this configuration and implementation is design choice and dictated by space and the type of motor used to drive a peristaltic pump. FIG. 10 illustrates that a fluid delivery pipe 408*a* is connected through an end wall 611 and thus engaged into a rear coupling 700 of tubular piercing member 260 that is arranged to pierce the lid of the fluid cartridge 300 (as described above). The tubular piercing member 260 may itself sit within a grommet 603 that provides a means of sealing handle 106 from the reservoir compartment 220 in the body of the core.

In more detail and with additional reference to FIG. 12, the fluid delivery pipe 408*a* connects into a chassis 604 through an adaptor 606, which chassis is shaped to support a cylindrical rotor 608 containing a circumferential guide channel 610 in which is held a U-shaped portion 408*a* of the fluid delivery pipe. At least one (and preferably at least two) squeeze roller(s) 612 is engaged in the rotor 608 and across the circumferential guide channel 610 so that, upon motorized rotation of the rotor 608 by a motor 614 having a drive spindle 616 coupled to the rotor 608, the rotor rotates and the squeeze roller 612 presses on the U-shaped portion 408*a* of the fluid delivery pipe; this realizes the peristaltic pump. The U-shaped portion is typically formed by a flexible pipe being shaped by the circumferential guide channel 610. Indeed, the nature of the material contributes to the decision on the number of rollers used in the peristaltic pump.

The motor 614 (for the peristaltic pump) may be held in place by a retaining bracket 632 that engages over the motor and secure to the pump assembly carriage 602.

In specific and exemplary content of FIG. 11, rotation of the rotor would be anticlockwise in order to push cartridge fluid through and along the fluid delivery pipe 408 (via a second adaptor 622 that connects the U-shaped pipe to a further pipe 408*b* that is routed internally through the vibrator via the core and tip) and then egressing outwardly from the nipple 172 and orifice 176 in the sheath cover. Moreover, operation of the peristaltic pump means that a negative pressure is created in the lubricant cartridge 300 which permits the cartridge to contract under atmospheric pressure and therefore to present cartridge fluid to the tubular piercing member 260 and into the pipe and rotor. Negative pressure also improves sealing at and about the tubular piercing member 260. Seepage from the orifice 176 using the system of positive displacement according to this aspect of the invention is highly controlled, if not negligible.

In fact, microprocessor controlled operation of the motor 614 and consequential controlled rotation of rotor 606 can cause a set amount (typically about 2 ml, but generally less than about 5 ml) of cartridge fluid to be exuded into the lubricant delivery pipe and ejaculated (or otherwise released in a somewhat rapid but controlled fashion) from orifice 176 in the sheath cover (via the nipple 172 formed in the tip). Equally, the electric motor can be controlled (via user instructions entered through the interface 108) to run an extended cycle to permit purging of the entire fluid delivery pipework with fresh cartridge fluid; this allows for cleaning of the pipework. In fact, the pump can be set to run for short periods throughout use of the vibrator, thereby improving body lubrication and/or levels of chemical or hormone dosing with time.

As will be understood, electrical connections 630 provide current to the pump's motor, with the connection coupled to the battery 206 (of FIG. 4). The pump's motor may be secured in place in pump assembly carriage 602 by screw-retainer. The pump assembly carriage 602 is therefore located (preferably) entirely within the handle 106 of the vibrator 100.

This new configuration and use of a peristaltic pump to provide positive displacement in a vibrator therefore provides for an automated lubricant delivery of cartridge fluid, which delivery may be triggered by a user or otherwise controlled according to a timing sequence run by the microprocessor 202 of the vibrator. The peristaltic pump does not contact the cartridge fluid directly and does not therefore introduce potential contamination to the cartridge fluid 301. Indeed, the lubricant delivery system is a closed system that can be cleaned by flushing the various connected pipes and connection adaptors with virgin cartridge fluid or a cleaning fluid delivered by a modified cartridge inserted into the vibrator.

In sum, the contemplated vibrator has better sensitivity control through the use of a dampening ring to isolate and concentrate vibration effects, and also an automated and improved lubrication system that was hitherto unrealized.

Vibration isolation can be practiced independently on any automatic lubricant delivery, with the lubricant delivery system particularly discussed in the FIGS. 1 to 8 omitted from the device to simplify its construction and operation. Equally, vibration isolation can be omitted, with the vibrator of FIG. 8 therefore being manually workable and potentially having no motorised vibration effect. Of course, as is preferred, a fully functioning vibrator according to a preferred embodiment makes use of both vibration dampening (through the use of one or more dampening rings) and the automated lubrication system based on the peristaltic pump.

It will be further understood that unless features in the particular preferred embodiments are expressly identified as incompatible with one another or the surrounding context implies that they are mutually exclusive and not readily combinable in a complementary and/or supportive sense, the totality of this disclosure contemplates and envisions that specific features of those complementary embodiments can be selectively combined to provide one or more comprehensive, but slightly different, technical solutions. For example, the use of the lubricant cartridge (and therefore the inclusion of the integrated pump) can be entirely independent or complementary to the dampening ring used to localize vibration effects. Clearly, if the pump and lubricant cartridge are not required, the compartment 220 may be used to house additional motors that bring about targeted vibration at specific areas. Alternatively, the body of the vibrator can be simplified to reduce the compartment's size or design.

It will, of course, be appreciated that the above description has been given by way of example only and that modifications in details may be made within the scope of the present invention. For example, while a preferred embodiment describes the use of a single motor within the shaft, it is envisioned that the multiple localised motors may be deployed within the shaft and separated by one or more dampening collars. Furthermore, it will be appreciated that the dampening collar may be employed in the main shaft and/or in as secondary spur that supports contemporaneous excitation of internal and external body organs, such as the clitoris and vagina. This arrangement reflects the "rabbit" configuration discussed above and reflects the fact that motors need not be in-line or actuated contemporaneously.

With respect to the piercing of the cartridge, the hollow piercing member is considered an optimal way of gaining access to the cartridge fluid and priming the system, especially since this means that the chances of having the cartridge fluid contact any part of the system other than the pipe network are mitigated and the cartridge fluid is not exposed to air (and potential contaminants). However, there are alternative solutions, including the press-fit of the collar of the cartridge into a retainer or the screw fitting of the cartridge into the retainer (that both holds the cartridge and provides access to the pipe network). In this later respect, the cartridge may, in fact, have a lid that is physically removed prior to loading into the retainer, or otherwise the mechanism of screwing a threaded collar of the cartridge into the retainer may rupture the lid to allow cartridge fluid to flow.

While the cartridge is preferably produced having a unitary plastic body that in effect is a collapsible bag, it is also contemplated that the cartridge could be produced with a body having a movable piston that moves (under fluid egress and a net negative pressure) to reduces cartridge volume with time. This syringe-based arrangement may, furthermore, be replenishable and multi-use.

The term "vibrator" should therefore be understood to relate to any electrically operable intimate massaging device, irrespective of shape and irrespective of whether it is designed for use in vaginal or anal applications or used internally or externally.

What is claimed is:

1. An adult sex toy containing a self-lubricating system, the adult sex toy being substantially phallus-shaped and configured for insertion into a human body cavity, the adult sex toy comprising:

a pipe network;

an aperture formed in the adult sex toy, the aperture connected to the pipe network to provide an outlet therefor;

a peristaltic pump engaging externally against the pipe network, the peristaltic pump having a rotor assembly configured to positively engage and squeeze a section of the pipe network;

a battery supplying electrical energy to the peristaltic pump to power the pump;

a hollow core retaining a removable volume-collapsible lubricant cartridge having an inner volume filled, initially, with a dispensable fluid or gel;

a tubular piercing member located in the hollow core, the tubular piercing member engaging into the removable volume-collapsible lubricant cartridge to provide a fluid conduit to the pipe network thereby to allow the dispensable fluid or gel to be controllably dispensed from the aperture under operation of the peristaltic pump and wherein the fluid conduit provides an egress path to the inner volume of the removable volume-collapsible lubricant cartridge when the removable volume-collapsible lubricant cartridge is both loaded into the hollow core of the adult sex toy and connected into the pipe network through the tubular piercing member; and a microcontroller coupled to the peristaltic pump to control operation thereof, the microcontroller configured to regulate operation of the peristaltic pump by causing the rotor assembly to selectively spin in order to (i) urge fluid or gel to travel controllably through the pipe network in a direction of the outlet and (ii) control release and delivery of the fluid or the gel from the removable volume-collapsible lubricant cartridge.

2. The adult sex toy according to claim 1, wherein the removable volume-collapsible lubricant cartridge is configured to seal about the tubular piercing member.

3. The adult sex toy according to claim 2, wherein the microcontroller is configured to control the peristaltic pump, such that the peristaltic pump operates according to at least one of:

a period basis designed to restrict fluid outflow from the outlet to between about 2 ml and less than about 5 ml;

for an extended continuous basis to purge the pipe network; and a user command provided through a control interface on the adult sex toy.

4. The adult sex toy according to claim 2, wherein the tubular piercing member brings about alignment, in use, of the removable volume-collapsible lubricant cartridge delivering one or more of a water-based organ lubricant, an oil-based organ lubricant, a liquid or gel chemical stimulant for stimulation of sex organs, a liquid or gel de-sensitizer that reduces sex organ sensitivity and a chemical that is spermicidal to the pipe network.

5. The adult sex toy according to claim 4, wherein the hollow core comprises an access door, the access door arranged to effect engagement of the tubular piercing member into the removable volume-collapsible lubricant cartridge.

6. The adult sex toy according to claim 2, wherein the hollow core is molded and has a distal end formed to contain a nipple as said outlet, the adult sex toy further including a removable sheath cover that, in situ, stretches over the hollow core, the sheath cover having a head with an orifice located to align with the nipple and wherein the nipple is configured to engage an end of the pipe network.

7. The adult sex toy according to claim 2, wherein the peristaltic pump is located within a handle of the adult sex toy.

8. The adult sex toy according to claim 2, wherein the adult sex toy is a vibrator.

9. The adult sex toy according claim 4, wherein the aperture is formed as a nipple that, in use, surrounds and secures an open end of the pipe network.

10. The adult sex toy according to claim 1, wherein the removable volume-collapsible lubricant cartridge contains a cartridge fluid or gel including one or more of:

a water-based organ lubricant, an oil-based organ lubricant, a liquid or gel chemical stimulant for stimulation of sex organs, a liquid or gel de-sensitizer that reduces sex organ sensitivity, or a chemical that is spermicidal.

11. The adult sex toy according to claim 10, wherein the removable volume-collapsible lubricant cartridge is a one-time use collapsible cartridge having a neck portion capped by a breakable seal.

12. The adult sex toy according to claim 1, wherein the peristaltic pump is configured to urge the dispensable fluid or gel according to a programmed sequence.

* * * * *